US007027765B2

(12) United States Patent
Han

(10) Patent No.: US 7,027,765 B2
(45) Date of Patent: Apr. 11, 2006

(54) APPARATUS AND METHOD FOR IDENTIFYING PAPER CASSETTES

(75) Inventor: Chun-ku Han, Gyeonggi-do (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 255 days.

(21) Appl. No.: 10/727,050

(22) Filed: Dec. 4, 2003

(65) Prior Publication Data

US 2004/0155396 A1 Aug. 12, 2004

(30) Foreign Application Priority Data

Dec. 10, 2002 (KR) ..... 10-2002-0078160

(51) Int. Cl.
*G03G 15/00* (2006.01)

(52) U.S. Cl. ..... 399/391; 399/12; 400/624; 271/9.01; 271/9.05; 271/9.06

(58) Field of Classification Search ..... 399/12, 399/391; 400/624; 271/9.01–9.08
See application file for complete search history.

(56) References Cited

U.S. PATENT DOCUMENTS 4,849,790 A * 7/1989 Ito ..... 399/367
5,414,532 A * 5/1995 Akiyama ..... 358/468
2003/0098540 A1* 5/2003 Hong ..... 271/9.01

FOREIGN PATENT DOCUMENTS

JP 5-69988 3/1993
JP 10-316253 12/1998

* cited by examiner

*Primary Examiner*—Andrew H. Hirshfeld
*Assistant Examiner*—Dave A. Ghatt

(57) ABSTRACT

An apparatus and method for identifying paper cassettes. The apparatus for identifying paper cassettes includes first through N-th paper cassettes, wherein each of N-1 output ports (where N is a positive integer greater than 1) is connected to N-1 input ports, which have one of N input ports and one of N output ports, a paper cassette identification unit to generate a synchronizing signal in response to an identification symbol which is transmitted from the first through N-th paper cassettes and indicates one of the first through N-th paper cassettes, and to transmit the generated synchronizing signal to paper cassettes in which an "undefined symbol" that indicates that the identification symbol has not been assigned, among the first through N-th paper cassettes is given, and a serial bus which connects the first through N-th paper cassettes to the paper cassette identification unit.

9 Claims, 3 Drawing Sheets

FIG. 2

| | FIRST LOOP | | SECOND LOOP | | THIRD LOOP | | • • • | N-th LOOP | |
|---|---|---|---|---|---|---|---|---|---|
| | INPUT PORT SIGNAL | IDENTIFICATION SYMBOLS/ UNDEFINED SYMBOLS | INPUT PORT SIGNAL | IDENTIFICATION SYMBOLS/ UNDEFINED SYMBOLS | INPUT PORT SIGNAL | IDENTIFICATION SYMBOLS/ UNDEFINED SYMBOLS | • • • | INPUT PORT SIGNAL | IDENTIFICATION SYMBOLS/ UNDEFINED SYMBOLS |
| FIRST PAPER CASSETTE | FIRST SIGNAL(L) | IDENTIFICATION SYMBOL(1) | | | | | | | |
| SECOND PAPER CASSETTE | SECOND SIGNAL(H) | UNDEFINED SYMBOL(T) | FIRST SIGNAL(L) | IDENTIFICATION SYMBOL(2) | | | | | |
| THIRD PAPER CASSETTE | SECOND SIGNAL(H) | UNDEFINED SYMBOL(T) | SECOND SIGNAL(H) | UNDEFINED SYMBOL(T) | FIRST SIGNAL(L) | IDENTIFICATION SYMBOL(3) | | | |
| ⋮ | ⋮ | ⋮ | ⋮ | ⋮ | ⋮ | ⋮ | ⋮ | | |
| N-th PAPER CASSETTE | SECOND SIGNAL(H) | UNDEFINED SYMBOL(T) | SECOND SIGNAL(H) | UNDEFINED SYMBOL(T) | SECOND SIGNAL(H) | UNDEFINED SYMBOL(T) | • • • | FIRST SIGNAL(L) | IDENTIFICATION SYMBOL(N) |

APPARATUS AND METHOD FOR IDENTIFYING PAPER CASSETTES

CROSS-REFERENCE TO RELATED APPLICATIONS

This application claims the benefit of Korean Patent Application No. 2002-78160, filed on Dec. 10, 2002, in the Korean Intellectual Property Office, the disclosure of which is incorporated herein by reference.

BACKGROUND OF THE INVENTION

1. Field of the Invention

The present invention relates to an image forming apparatus which can print on various types of paper, and more particularly, to an apparatus and method for identifying paper cassettes by using a simple structure.

2. Description of the Related Art

An image forming apparatus such as a printer includes a plurality of paper cassettes for supporting paper. Paper which corresponds to a paper size selected by a user is extracted from the plurality of paper cassettes, and a printing operation is performed.

In the conventional image forming apparatus, two methods for identifying a plurality of paper cassettes have been used. In the first method, an identification symbol is assigned to each of the paper cassettes, and a main controller identifies the identification symbols included in the apparatus, and the main controller and the paper cassettes are independently connected to serial buses, respectively. Thus, the number of serial buses is the same as the number of paper cassettes. Therefore, when a paper cassette which corresponds to a specific identification symbol is detected by the main controller, a signal is transmitted to a unit in the apparatus via a serial bus connected to the corresponding paper cassette, and paper of a corresponding size is used from the detected paper cassette.

In the second method, a main controller and paper cassettes are connected to one serial bus, and each of the paper cassettes comprises a switch so that a user can manually set identification symbols.

In the first method, the number of connection lines of the serial buses should be the same as the number of paper cassettes, and therefore, it may be difficult to manufacture an image forming apparatus and manufacturing costs may increase.

In the second method, the user manually sets the identification symbols one by one by operating the switch of each paper cassette. Also, when the user mistakenly fails to operate the switch, due to wrong setting of the identification symbols, errors may occur while the image forming apparatus is operating.

SUMMARY OF THE INVENTION

Accordingly, it is an aspect of the present invention to provide a method of and an apparatus for identifying paper cassettes by using a simple structure without requiring a plurality of independent serial buses.

Additional aspects and/or advantages of the invention will be set forth in part in the description which follows and, in part, will be obvious from the description, or may be learned by practice of the invention.

The foregoing and/or other aspects of the present invention may be achieved by providing an apparatus for identifying paper cassettes of an image forming apparatus which supports to output various types of paper comprising first through N-th paper cassettes, wherein each of N-1 (where N is a positive integer greater than 1) output ports is connected to N-1 input ports each having one of N input ports and one of N output ports, a paper cassette identification unit which generates a synchronizing signal in response to an identification symbol which is transmitted from one of the first through N-th paper cassettes and indicates one of the first through N-th paper cassettes, and transmits the generated synchronizing signal to paper cassettes in which an "undefined symbol" that indicates that an identification signal has not been assigned, among the first through N-th paper cassettes is given, and a serial bus which connects the first through N-th paper cassettes to the paper cassette identification unit.

It is another aspect of the present invention to provide a method for identifying paper cassettes of an image forming apparatus having first through N-th (where N is a positive integer greater than 1) paper cassettes in which paper is held and which supports to output various types of paper, the method comprising an electrical source being applied to each of the first through N-th paper cassettes and providing first and second signals to each of the first through N-th paper cassettes, determining whether the first signal is provided to one of the first through N-th paper cassettes, upon determining that the first signal is provided to one of the one of the first through N-th paper cassettes, assigning an identification symbol which indicates the first through N-th paper cassettes to which the first signal is provided, and transmitting identification symbol to a paper cassette identification unit which identifies the first through N-th paper cassettes, converting the second signal outputted from an output port of one of the first through N-th paper cassettes in which the identification symbol has been assigned, into a first signal, upon determining that the first signal is not provided to one of the first through N-th paper cassettes, assigning "undefined symbol" which indicates that the identification symbol has not been assigned in the first through N-th paper cassettes to which the second signal is provided, and determining whether a synchronizing signal is supplied to the first through N-th paper cassettes in which the "undefined symbol" has been given, from the paper cassette identification unit, and upon determining that the synchronizing signal is supplied to the first through N-th paper cassettes, then determining whether the first signal is provided to one of the first through the N-th paper cassettes.

BRIEF DESCRIPTION OF THE DRAWINGS

These and/or other aspects and advantages of the invention will become apparent and more readily appreciated from the following description of the embodiments taken in conjunction with the accompanying drawings of which:

FIG. 2 is a table illustrating the operation of assigning identification symbols shown in FIG. 1, according to an embodiment of the present invention.

DETAILED DESCRIPTION OF THE PREFERRED EMBODIMENTS

Figure 1:
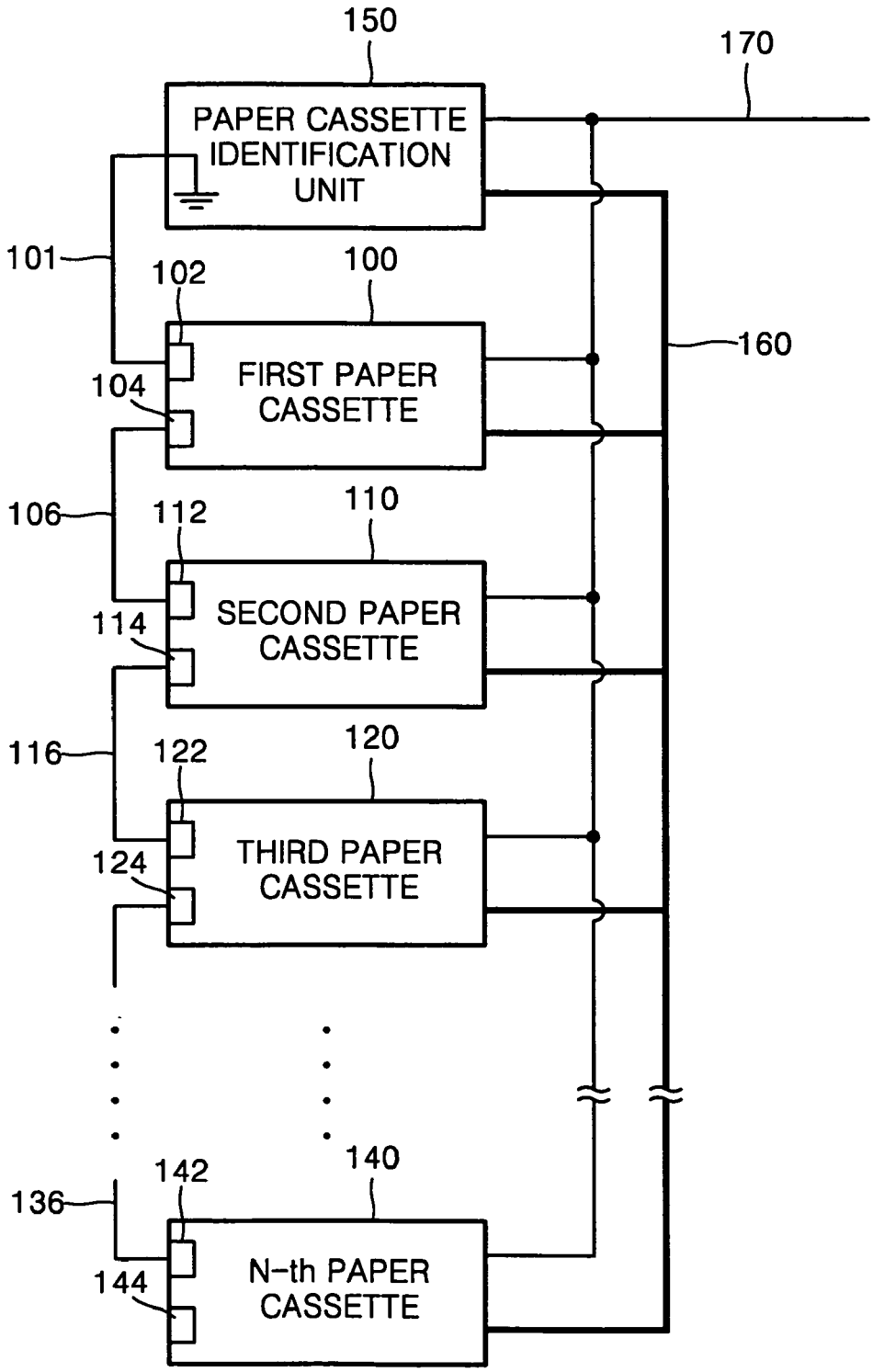
FIG. 1 is a block diagram illustrating an apparatus for identifying paper cassettes according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

FIG. 1 is a block diagram illustrating an apparatus for identifying paper cassettes according to an embodiment of the present invention. Referring to FIG. 1, the apparatus comprising first through N-th (where N is a positive integer greater than 1) paper cassettes 100 through 140, a paper cassette identification unit 150, a serial bus 160, and an electrical source supply line 170.

Each of the first through N-th paper cassettes 100 through 140 has one of N input ports and one of N output ports. Each of the N-1 output ports is connected to each of the N-1 input ports.

When an electrical source is supplied to the first through N-th paper cassettes 100 through 140 from the electrical source supply line 170, a first signal is inputted into one of the N input ports included to the first through N-th paper cassettes 100 through 140, and a second signal is inputted into or outputted from the N-1 input ports and the N-1 output ports, respectively.

An M (where M is a positive integer smaller than or equal to N) paper cassette into which the first signal is inputted is assigned an identification symbol which identifies one of the first through N-th paper cassettes 100 through 140, and transmit the identification symbol to the paper cassette identification unit 150. Also, the M paper cassette into which the first signal is inputted converts the second signal outputted from the output port of the M paper cassette, into the first signal.

Meanwhile, N-M paper cassettes into which the second signal is inputted are assigned an "undefined symbol", which indicates that an identification symbol has not been assigned.

The first paper cassette 100 has a first input port 102 and a first output port 104. The first input port 102 of the first paper cassette 100 may be grounded. Thus, a first signal is always inputted into the first input port 102 via a ground connection line 101 when an electrical source is applied to the first paper cassette 100 from the electrical source supply line 170. The first signal may be at a "high" or "low" level. If the first input port 102 is grounded, the first signal having a "low" level is inputted into the first input port 102. A second signal is outputted via a first connection cable 106 from the first output port 104 when the electrical source is applied to the first paper cassette 100 from the electrical source supply line 170. The second signal may be at a "high" or "low" level in opposition to the first signal. If the first input port 102 is grounded and the first signal having a "low" level is inputted into the first input port 102, the second signal having a "high" level is outputted from the first output port 104.

The first paper cassette 100 senses that the first signal is inputted into the first input port 102, and is assigned an identification symbol which indicates the first paper cassette 100. Also, the first paper cassette 100 transmits the identification symbol to the paper cassette identification unit 150. Also, the first paper cassette 100 converts the second signal outputted from the first output port 104, into the first signal after the identification symbol is transmitted to the paper cassette identification unit 150.

The second paper cassette 110 has a second input port 112 and a second output port 114. The second input port 112 is connected to the first output port 104 of the first paper cassette 100 via a first connection cable 106. When an electrical source is applied to the second paper cassette 110 from the electrical source supply line 170, a second signal is inputted into the second input port 112, and the second signal is outputted from the second output port 114. When the second signal is inputted into the second input port 112, the second paper cassette 110 is assigned an "undefined symbol" which indicates that an identification symbol has not been assigned. Then, the second paper cassette 110 receives the first signal via the first connection cable 106 from the first output port 104 of the first paper cassette 100.

If a synchronizing signal is transmitted to the second paper cassette 110 from the paper cassette identification unit 150, the second paper cassette 110 senses that the signal inputted into the second input port 112 is the first signal, and is assigned an identification symbol which indicates the second paper cassette 110. The synchronizing signal is generated in the paper cassette identification unit 150, so as to be used to assigned identification symbols for each of the first through N-th paper cassettes. The second paper cassette 110 transmits the identification symbol to the paper cassette identification unit 150. Also, the second paper cassette 110 converts the second signal outputted from the second output port 114, into the first signal after the identification symbol is transmitted to the paper cassette identification unit 150.

The third paper cassette 120 has a third input port 122 and a third output port 124. The third input port 122 is connected to the second output port 114 of the second paper cassette 110 via a second connection cable 116. When an electric source is applied to the third paper cassette 120 from the electric source supply line 170, a second signal is inputted into the third input port 122, and the third signal is outputted from the third output port 124. When the second signal is inputted into the third input port 122, the third paper cassette 120 is assigned an "undefined symbol" which indicates that an identification symbol has not been assigned. Then, the third paper cassette 120 receives the first signal via the second connection cable 116 from the second output port 114 of the second paper cassette 110.

If a synchronizing signal is transmitted to the third paper cassette 120 from the paper cassette identification unit 150, the third paper cassette 120 senses that the signal inputted into the third input port 122 is the first signal, and is assigned an identification symbol which indicates the third paper cassette 120. The third paper cassette 120 transmits the identification symbol to the paper cassette identification unit 150. Also, the third paper cassette 120 converts the second signal outputted from the third output port 124, into the first signal after the identification symbol is transmitted to the paper cassette identification unit 150.

Descriptions of fourth through (N-1)-th paper cassettes (not shown) are the same as the above-mentioned second or third paper cassette, and thus descriptions thereof will be omitted.

The N-th paper cassette 140 has an N-th input port 142 and an N-th output port 144. The N-th input port 142 is connected to an (N-1)-th output port (not shown) of the (N-1)-th paper cassette via an (N-1)-th connection cable 136. The N-th output port 144 is not connected to anything.

When an electric source is applied to the N-th paper cassette 140 from the electric source supply line 170, a second signal is inputted into the N-th input port 142, and the second signal is outputted from the N-th output port 144. When the second signal is inputted into the N-th input port 142, the N-th paper cassette 140 is assigned an "undefined symbol" which indicates that an identification symbol has not been assigned. After that, the N-th paper cassette 140 receives the first signal via the (N-1)-th connection cable 136 from an (N-1)-th output port (not shown) of an (N-1)-th paper cassette.

If a synchronizing signal is transmitted to the N-th paper cassette 140 from the paper cassette identification unit 150, the N-th paper cassette 140 senses that the signal inputted into the N-th input port 142 is the first signal, and is assigned an identification symbol which indicates the N-th paper cassette 140. The N-th paper cassette 140 transmits the identification symbol to the paper cassette identification unit 150. Also, the N-th paper cassette 140 converts the second signal outputted from the N-th output port 144, into the first signal after the identification symbol is transmitted to the paper cassette identification unit 150.

The paper cassette identification unit 150 generates a synchronizing signal in response to an identification symbol which is transmitted from the first through N-th paper cassettes 100 through 140, and transmits the generated synchronizing signal to paper cassettes in which an "undefined symbol" that indicates that an identification symbol has not been assigned are given, among the first through N-th paper cassettes 100 through 140.

Also, the paper cassette identification unit 150 receives a predetermined identification symbol from one of the first through N-th paper cassettes in which the identification symbol has been assigned, and stops generation of the synchronizing signal. The paper cassette identification unit 150 stores information on the predetermined identification symbol among the identification symbols. If the paper cassette identification unit 150 receives the same identification symbol as the predetermined identification symbol, the paper cassette identification unit 150 senses that the identification symbols of all of the paper cassettes are assigned, and stops generation of the synchronizing signal. For example, if the first through N-th paper cassettes are provided and the paper cassette identification unit 150 stores information on an identification symbol "N", when the paper cassette identification unit 150 receives "N" as an identification symbol of the N-th paper cassette, the paper cassette identification unit 150 senses that all of the identification symbols are assigned and stops generation of the synchronizing signal.

The serial bus 160 connects the first through N-th paper cassettes 100 through 140 to the paper cassette identification unit 150. The serial bus 160 connects the first through N-th paper cassettes to the paper cassette identification unit 150 via only one line, unlike in the conventional image forming apparatus. Thus, the serial bus 160 serves as a path through which the identification symbols assigned in the first through N-th paper cassettes 100 through 140 are transmitted to the paper cassette identification unit 150. Also, the serial bus 160 serves as a path through which the synchronizing signal generated in the paper cassette identification unit 150 is transmitted to the paper cassettes in which the "undefined symbols" are given.

The electric source supply line 170 represents a traditional cable, and therefore the description will be omitted.

FIG. 2 is a table illustrating the operation of assigning identification symbols shown in FIG. 1, according to the embodiment of the present invention. FIG. 2 shows the result of assigning of identification symbols and "undefined symbols" when first through N-th loops are performed according to the present invention shown in FIG. 2.

The first loop is performed when an electrical source is applied to the first through N-th paper cassettes 100 through 140 and the paper cassette identification unit 150.

Since the first input port 102 is grounded, a first signal having a "low (L)" level is continuously inputted into the first input port 102 of the first paper cassette 100. When the electric source is applied to the first paper cassette 100, a second signal having a "high (H)" level is outputted from the first output port 104 of the first paper cassette 100. The first paper cassette 100 senses that the first signal is inputted into the first input port 102, and is assigned an identification signal "1" which indicates the first paper cassette 100. Also, the first paper cassette 100 transmits the identification symbol "1" to the paper cassette identification unit 150 The first paper cassette 100 then converts the second signal having the "high (H)" level, outputted from the first output port 104, into a first signal having a "low (L)" level. Meanwhile, the paper cassette identification unit 150 receives the identification symbol "1" from the first paper cassette 100 and generates a synchronizing signal.

When the electric source is applied to the second paper cassette 110, a second signal having a "high (H)" level is inputted into the second input port 112 of the second paper cassette 110, and the second signal having the "high (H)" level is outputted from the second output port 114. Thus, since the second signal having the "high (H)" level is inputted into the second input port 112 of the second paper cassette 110, the second paper cassette 110 is assigned an "undefined symbol T" which indicates that an identification symbol has not been assigned.

When the electric source is applied to each of the third through N-th paper cassettes 120 through 140, as in the second paper cassette 110, the second signal having the "high (H)" level is inputted into each of input ports of the third through N-th paper cassettes 120 through 140, and the second signal having the "high (H)" level is outputted from each of output ports of the third through N-th paper cassettes 120 through 140. Thus, each of the third through N-th paper cassettes 120 are assigned an "undefined symbol T" which indicates that an identification symbol has not been assigned.

The second loop is performed when the synchronizing signal generated in the paper cassette identification unit 150 during the first loop operation is transmitted to the second through N-th paper cassettes 110 through 140 in which the "undefined symbol T" is given. The synchronizing signal is not transmitted to the first paper cassette 100 in which the identification symbol is assigned.

A first signal having a "low (L)" level is inputted into the second input port 112 of the second paper cassette 110 from the first output port 104 of the first paper cassette 100 after the first loop operation. If the synchronizing signal is transmitted to the second paper cassette 110 in which the "undefined symbol T" is given, the second paper cassette 110 senses that the signal inputted into the second input port 112 is the first signal having the "low (L)" level, and is assigned an identification symbol "2" which indicates the second paper cassette 110. Also, the second paper cassette 110 transmits the identification symbol "2" to the paper cassette identification unit 150. The second paper cassette 110 then converts the second signal having the "high (H)" level outputted from the second output port 114, into the first signal having the "low (L)" level.

The third through N-th paper cassettes 120 through 140 in which the "undefined symbol T" is given respectively, receive the synchronizing signal. The second signal having the "high (H)" level is inputted into each of input ports of the third through N-th paper cassettes 120 through 140. Also, the second signal having the "high (H)" level is outputted from each of output ports of the third through N-th paper cassettes 120 through 140. Thus, since the second signal having the "high (H)" level is inputted into the third through N-th paper cassettes 120 through 140, the "undefined symbol T" about each of the paper cassettes is assigned again. The third through (N-1)-th loop repeat the above-mentioned operations.

The N-th loop is performed when the synchronizing signal generated in the paper cassette identification unit 150 is transmitted to the N-th paper cassette 140 in which the "undefined symbol "T" has been given. The synchronizing signal is not transmitted to the first through (N-1)-th cassettes in which an identification symbol has been assigned respectively.

The first signal having the "low (L)" level is inputted into the N-th input port 142 of the N-th paper cassette 140 from the (N-1)-th output port (not shown) of the (N-1)-th paper cassette (not shown) after the (N-1)-th loop operation. If the synchronizing signal is transmitted to the N-th paper cassette 140 in which the "undefined symbol T" has been given, the N-th paper cassette 140 senses that the signal inputted into the N-th input port 142 is a first signal having the "low (L)" level, and assigns an identification symbol "N" which indicates the N-th paper cassette 140. Also, the N-th paper cassette 140 transmits the identification symbol "N" to the paper cassette identification unit 150. Also, the N-th paper cassette 140 converts the second signal having the "high (H)" level outputted from the N-th output port 144, into the first signal having the "low (L)" level. Since an identification symbol is not assigned after the N-th paper cassette 140, the N-th paper cassette 140 does not need to convert the second signal having the "high (H)" level outputted from the N-th output port 144, into the first signal having the "second (L)" level.

Meanwhile, the paper cassette identification unit 150 senses that the identification symbol "N" received from the N-th paper cassette 140 is the same as information "N" about a predetermined identification symbol stored in the paper cassette identification unit 150 in advance, and stops generation of the above-mentioned synchronizing signal. Thus, all of identification symbols of the first through N-th paper cassettes 100 through 140 are assigned, and a current environment is changed into a printable environment.

Hereinafter, a method for identifying paper cassettes according to the present invention will be described with reference to the accompanying drawings.

Figure 3:
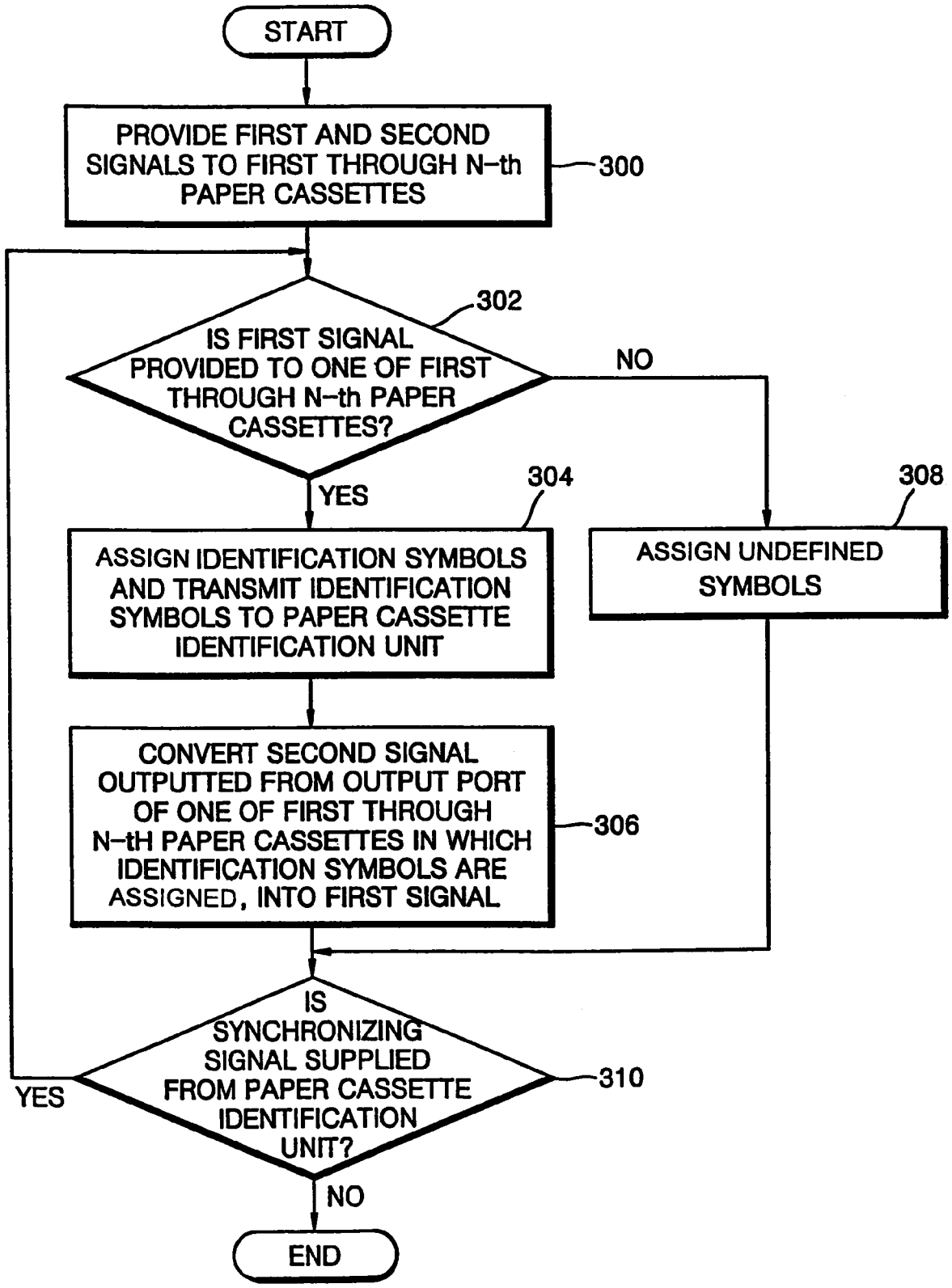
FIG. 3 is a flowchart illustrating a method for identifying paper cassettes according to an embodiment of the present invention.

FIG. 3 is a flowchart illustrating a method for identifying paper cassettes according to an embodiment of the present invention. The method comprises the operations 300 through 310 of discriminating first and second signals inputted into first through N-th paper cassettes 100 through 140 and assigning identification symbols of the first through N-th paper cassettes 100 through 140.

First, in operation 300, an electrical source is applied to each of the first through N-th paper cassettes 100 through 140, and thus, the first and second signals are provided to each of the first through N-th paper cassettes 100 through 140. The first signal is at a "high" or "low" level, and the second signal is complementary to the first signal.

In operation 302, it is determined whether the first signal is provided to one of the first through N-th paper cassettes 100 through 140. If it is determined that the first signal is not provided to one of the first through N-th paper cassettes 100 through 140, the method proceeds to operation 308.

However, if it is determined that the first signal is provided to one of the first through N-th paper cassettes 100 through 140, an identification symbol which indicates the first through N-th paper cassettes 100 through 140 to which the first signal is provided, is assigned, and the identification symbol is transmitted to a paper cassette identification unit 150 which identifies the first through N-th paper cassettes 100 through 140 (operation 304).

In operation 306, the second signal outputted from an output port of one of the first through N-th paper cassettes 100 through 140 in which the identification symbol has been assigned is converted into the first signal.

If it is determined in operation 302 that the first signal is not provided to one of the first through N-th paper cassettes 100 through 140, "undefined symbols" which indicate that the identification symbols have not been assigned are given in the first through N-th paper cassettes 100 through 140 to which the second signal is provided.

Next, in operation 310, the first through N-th paper cassettes 100 through 140 in which the "undefined symbols" are given, determine whether a synchronizing signal is supplied from the paper cassette identification unit 150. If it is determined that the synchronizing signal is supplied to the first through N-th paper cassettes 100 through 140, the method proceeds to operation 302, and if it is determined that the synchronizing signal is not supplied to the first through N-th paper cassettes 100 through 140, the method terminates the above-mentioned flowchart.

As described above, in the apparatus and method for identifying paper cassettes according to the present invention, paper cassettes can be identified through a simple structure, difficulties in manufacturing of an image forming apparatus can be reduced, manufacturing costs can be reduced and errors of identification of the paper cassettes which may occur while the image forming apparatus is operating can be reduced.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. An apparatus for identifying paper cassettes of an image forming apparatus which supports to output various types of paper, the apparatus comprising:

first through N-th paper cassettes, wherein each of N-1, where N is a positive integer greater than 1, output ports is connected to N-1 input ports, which have one of N input ports and one of N output ports;

a paper cassette identification unit which generates a synchronizing signal in response to an identification symbol which is transmitted from one of the first through N-th paper cassettes which indicates one of the first through N-th paper cassettes, and transmits the generated synchronizing signal to the paper cassettes in which an undefined symbol that indicates that an identification signal has not been assigned, among the first through N-th paper cassettes is given; and a serial bus which connects the first through N-th paper cassettes to the paper cassette identification unit.

2. The apparatus of claim 1, wherein in the first through N-th paper cassettes, when an electric source is applied to the first through N-th paper cassettes from an electric source supply line, a first signal is inputted into one of the N input ports, and a second signal is inputted into or outputted from each of the N-1 input ports and the N-1 output ports.

3. The apparatus of claim 2, wherein the first signal is at a "high" or "low" level, and the second signal is complementary to the first signal.

4. The apparatus of claim 3, wherein an M paper cassette where M is a positive integer smaller than or the same as N into which the first signal is inputted is assigned an identification symbol and transmits the identification symbol to the paper cassette identification unit, and an N-M paper cassette into which the second signal is inputted is assigned an undefined symbol, respectively.

5. The apparatus of claim 4, wherein the M paper cassette converts the second signal, outputted from the M output port of the M paper cassette, into the first signal.

6. The apparatus of claim 1, wherein the paper cassette identification unit receives a predetermined identification symbol from one of the first through N-th paper cassettes in which the identification symbol is assigned, and stops generation of the synchronizing signal.

7. The apparatus of claim 1, wherein the serial bus connects the first through N-th paper cassettes to the paper cassette identification unit via one line.

8. A method for identifying paper cassettes of an image forming apparatus having first through N-th paper cassettes where N is a positive integer greater than 1 in which paper is held and supports to output various types of paper, the method comprising:

applying an electrical source to each of the first through N-th paper cassettes and providing first and second signals to each of the first through N-th paper cassettes;

determining whether a first signal is provided to one of the first through N-th paper cassettes;

upon determining that the first signal is provided to one of the first through N-th paper cassettes, assigning an identification symbol which indicates the one of the first through N-th paper cassettes to which the first signal is provided, and transmitting the identification symbol to a paper cassette identification unit which identifies the first through N-th paper cassettes;

converting the second signal outputted from an output port of one of the paper cassettes in which the identification symbol is assigned, into a first signal;

upon determining that a first signal is not provided to one of the first through N-th paper cassettes, assigning undefined symbols which indicate that the identification symbols are not assigned in the first through N-th paper cassettes to which the second signal is provided; and upon determining whether a synchronizing signal is supplied to the first through N-th paper cassettes in which the undefined symbols are given, from the paper cassette Identification unit, and if it is determined that the synchronizing signal is supplied to one of the first through N-th paper cassettes, then determining whether the first signal is provide to one of the first through the Nth paper cassettes.

9. The method of claim 8, wherein the first signal is at a "high" or "low" level, and the second signal is complementary to the first signal.

* * * * *

UNITED STATES PATENT AND TRADEMARK OFFICE

CERTIFICATE OF CORRECTION

PATENT NO. : 7,027,765 B2
APPLICATION NO. : 10/727050
DATED : April 11, 2006
INVENTOR(S) : Chun-Ku Han It is certified that error appears in the above-identified patent and that said Letters Patent is hereby corrected as shown below:

Column 8, line 65: after “cassette” insert --,--.

Column 8, line 66: after “as N” insert --,--.

Column 9, line 17: after “cassettes” insert --,--.

Column 9, line 18: after “than 1” insert --,--.

Column 10, line 18: delete “Identification” and insert --identification-- therefor.

Column 10, line 22: delete “Nth” and insert --N-th-- therefor.

Signed and Sealed this

Fifteenth Day of August, 2006

JON W. DUDAS
*Director of the United States Patent and Trademark Office*